US008721028B2

(12) United States Patent
Petruchik et al.

(10) Patent No.: US 8,721,028 B2
(45) Date of Patent: May 13, 2014

(54) PRINTHEAD MAINTENANCE BASED ON INK SUPPLY INTERRUPTION

(75) Inventors: Dwight John Petruchik, Honeoye Falls, NY (US); Charles Francis Scaglione, Bergen, NY (US)

(73) Assignee: Eastman Kodak Company, Rochester, NY (US)

( * ) Notice: Subject to any disclaimer, the term of this patent is extended or adjusted under 35 U.S.C. 154(b) by 267 days.

(21) Appl. No.: 13/305,801

(22) Filed: Nov. 29, 2011

(65) Prior Publication Data

US 2013/0135367 A1 May 30, 2013

(51) Int. Cl.
*B41J 29/393* (2006.01)

(52) U.S. Cl.
USPC ..... 347/19; 347/6; 347/22; 347/23

(58) Field of Classification Search
USPC ..... 347/6, 7, 14, 19, 22, 23, 29–30, 35–36
See application file for complete search history.

(56) References Cited

U.S. PATENT DOCUMENTS

| | | | | |
|---|---|---|---|---|
| 5,506,611 | A * | 4/1996 | Ujita et al. | 347/86 |
| 6,126,265 | A | 10/2000 | Childers et al. | |
| 7,029,095 | B2 * | 4/2006 | Tsuboi et al. | 347/35 |
| 7,185,970 | B2 * | 3/2007 | Hamasaki | 347/23 |
| 7,350,902 | B2 | 4/2008 | Dietl et al. | |

* cited by examiner

*Primary Examiner* — Juanita D Jackson
(74) *Attorney, Agent, or Firm* — Peyton C. Watkins

(57) ABSTRACT

A method of controlling a maintenance operation in an inkjet printer, the method includes detecting that ink supply connection to a printhead has been interrupted; detecting that ink supply connection to the printhead has been restored; measuring a time interval between the interruption and the restoration of the ink supply connection to the printhead; and selecting a level of the maintenance operation, depending upon a length of the time interval.

18 Claims, 8 Drawing Sheets

PRINTHEAD MAINTENANCE BASED ON INK SUPPLY INTERRUPTION

FIELD OF THE INVENTION

The present invention relates generally to maintenance operations in an inkjet printer, and more particularly to controlling certain maintenance operations related to ink supply changeovers in a way that promotes efficient usage of ink.

BACKGROUND OF THE INVENTION

An inkjet printing system typically includes one or more printheads and their corresponding ink supplies. Each printhead includes an ink inlet that is connected to its ink supply and an array of drop ejectors, each ejector including an ink pressurization chamber, an ejecting actuator and an orifice through which droplets of ink are ejected. The ejecting actuator can be one of various types, including a heater that vaporizes some of the ink in the pressurization chamber in order to propel a droplet out of the orifice, or a piezoelectric device which changes the wall geometry of the chamber in order to produce a pressure wave that ejects a droplet. The droplets are typically directed toward paper or other recording medium (sometimes generically referred to as paper herein) in order to produce an image according to image data that is converted into electronic firing pulses for the drop ejectors as the print medium is moved relative to the printhead.

Motion of the print medium relative to the printhead can be accomplished by keeping the printhead stationary and advancing the print medium past the printhead while the drops are ejected. This architecture is appropriate if the nozzle array on the printhead can address the entire region of interest across the width of the print medium. Such printheads are sometimes called page-width printheads.

A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a direction that is substantially perpendicular to the print medium advance direction as the drops are ejected from the nozzles. After the carriage has printed a swath of the image while traversing the print medium, the print medium is advanced; the carriage direction of motion is reversed; and the image is formed swath by swath.

Inkjet ink includes a variety of volatile and nonvolatile components including pigments or dyes, humectants, image durability enhancers, and carriers or solvents. A key consideration in ink formulation is the ability to produce high quality images on the print medium. During periods when ink is not being ejected from an ejector, the ink viscosity at the nozzle can change. For example, the volatile components of the ink can evaporate through the nozzle. Such changes can make the drop ejection process non-uniform, so that the image quality can be degraded. In addition, dust, dried ink or other particulates can partially block a nozzle or make the wettability of the nozzle face around the nozzle non-uniform so that ejected drops can be misdirected from their intended flight paths. Additionally, when an ink supply is changed over, for example when an ink tank is replaced, some of the volatile ink components can evaporate at the point of the connection of the ink supply and cause an intake of air into the ink supply passageways.

In order to maintain the drop ejecting quality of the printhead so that high quality images are produced even after periods where one or more nozzles has been inactive, a variety of maintenance actions have been developed and are well known in the art. These maintenance actions can include capping the printhead nozzle face region during periods of nonprinting, wiping the nozzle face, periodically spitting drops from the nozzles into the cap or other reservoir that is outside the printing region, and priming the nozzles by applying a suction pressure at the nozzle face. To remove air accumulated in the ink supply passageways, suction priming by a vacuum applied at the nozzle face of the printhead is typically used. However, suction priming tends to remove a significant amount of ink from the printhead. This means that less ink is available for printing, and also that more waste ink should be stored in the printer.

What is needed is a way to select a level of maintenance after an ink supply changeover that is more efficient in ink usage. More efficient ink usage makes it possible for the user to change ink supplies less frequently, saving the user both effort and money, and also putting less waste into the environment.

SUMMARY OF THE INVENTION

The present invention is directed to overcoming one or more of the problems set forth above. Briefly summarized, according to one aspect of the invention, the invention resides in a method of controlling a maintenance operation in an inkjet printer, the method includes detecting that ink supply connection to a printhead has been interrupted; detecting that ink supply connection to the printhead has been restored; measuring a time interval between the interruption and the restoration of the ink supply connection to the printhead; and selecting a level of the maintenance operation, depending upon a length of the time interval.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
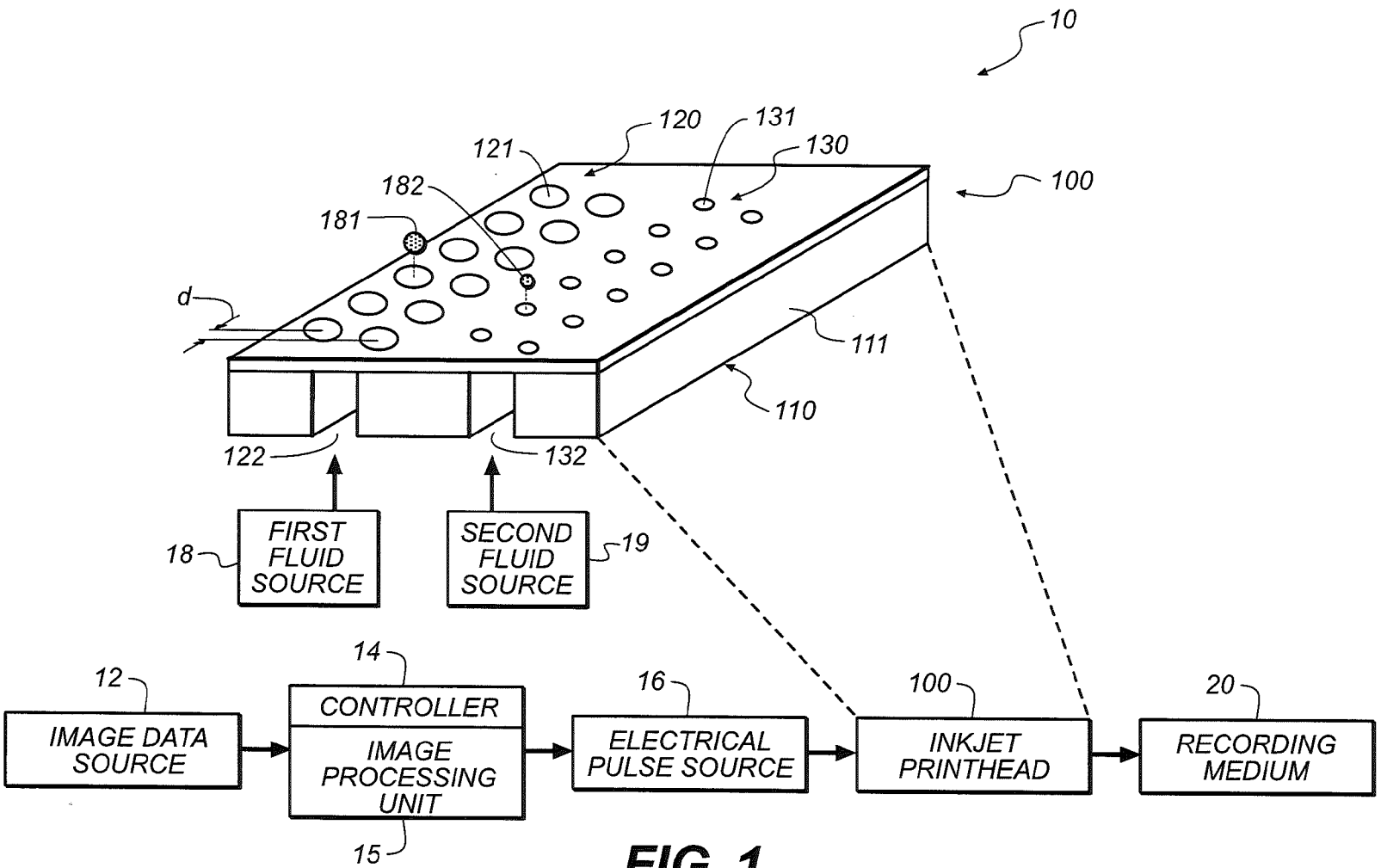
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays 120, 130 has two staggered rows of nozzles 121, 131, each row having a nozzle density of 600 per inch. The effective nozzle density then in each array is 1200 per inch (i.e. d=1/1200 inch in FIG. 1). If pixels on a recording medium 20 were sequentially numbered along the paper advance direction, the nozzles 121, 131 from one row of an array 120, 130 would print the odd numbered pixels, while the nozzles 121, 131 from the other row of the array 120, 130 would print the even numbered pixels.

In fluid communication with each nozzle array 120, 130 is a corresponding ink delivery pathway 122, 132. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through a printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, a first fluid source 18 supplies ink to first nozzle array 120 via ink delivery pathway 122, and second fluid source 19 supplies ink to second nozzle array 130 via ink delivery pathway 132. Although distinct first and second fluid sources 18 and 19 are shown, in some applications it is beneficial to have a single fluid source supplying ink to both the first nozzle array 120 and the second nozzle array 130 via ink delivery pathways 122 and 132 respectively. Also, in some embodiments, fewer than two or more than two nozzle arrays 120, 130 can be included on inkjet printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles 121, 131. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on the recording medium 20.

Figure 2:
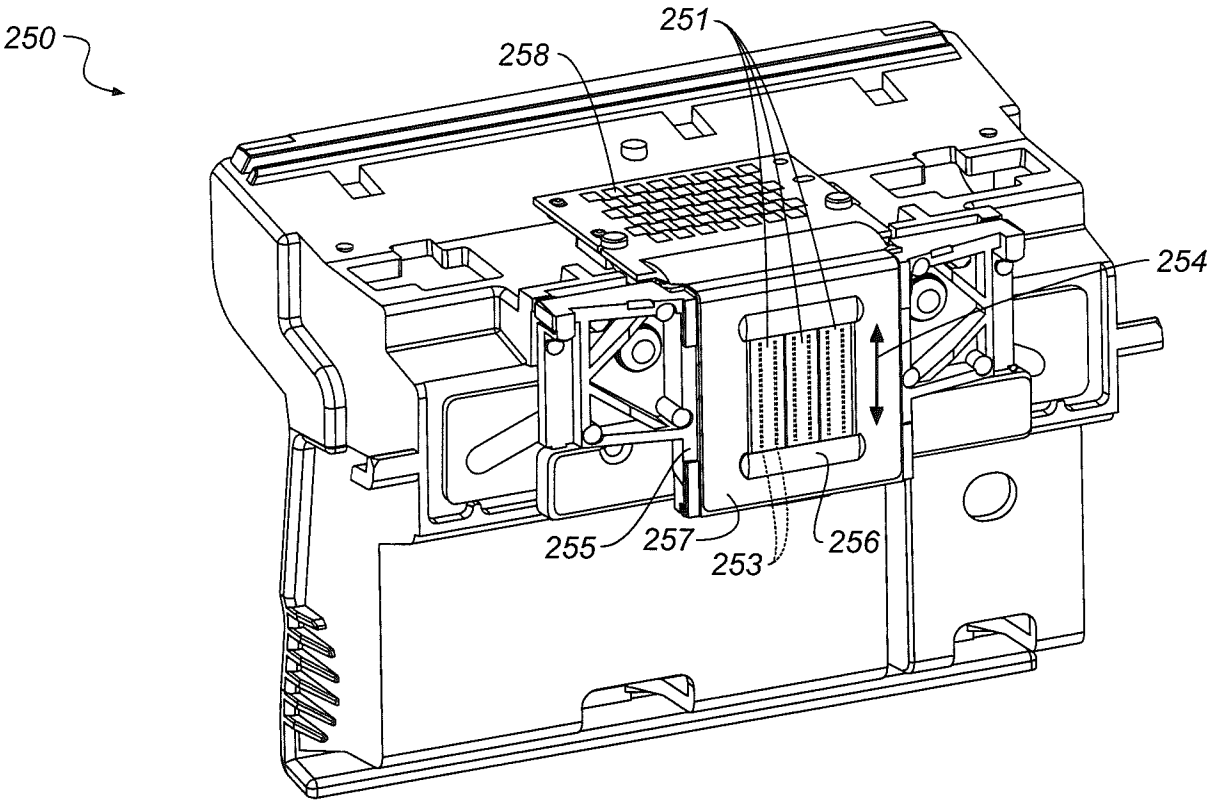
FIG. 2 is a perspective of a portion of a printhead.

FIG. 2 shows a perspective of a portion of a printhead 250, which is an example of the inkjet printhead 100. Printhead 250 includes three printhead die 251 (similar to inkjet printhead die 110 in FIG. 1) mounted on mounting substrate 255, each printhead die 251 containing two nozzle arrays 253, so that printhead 250 contains six nozzle arrays 253 altogether. The faces of the printhead die 251 that are visible in FIG. 2 are sometimes called the nozzle faces, since they include the nozzle arrays 253. The nozzle faces of the printhead die 251 are also sometimes called the nozzle face region of the printhead 250. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array 253 along the nozzle array direction 254 is typically on the order of 1 inch or less. Typical lengths of recording media 20 are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into a carriage 200 (see FIG. 3), connector board 258 is electrically connected to a connector (not shown) on the carriage 200, so that electrical signals can be transmitted to the printhead die 251.

Figure 3:
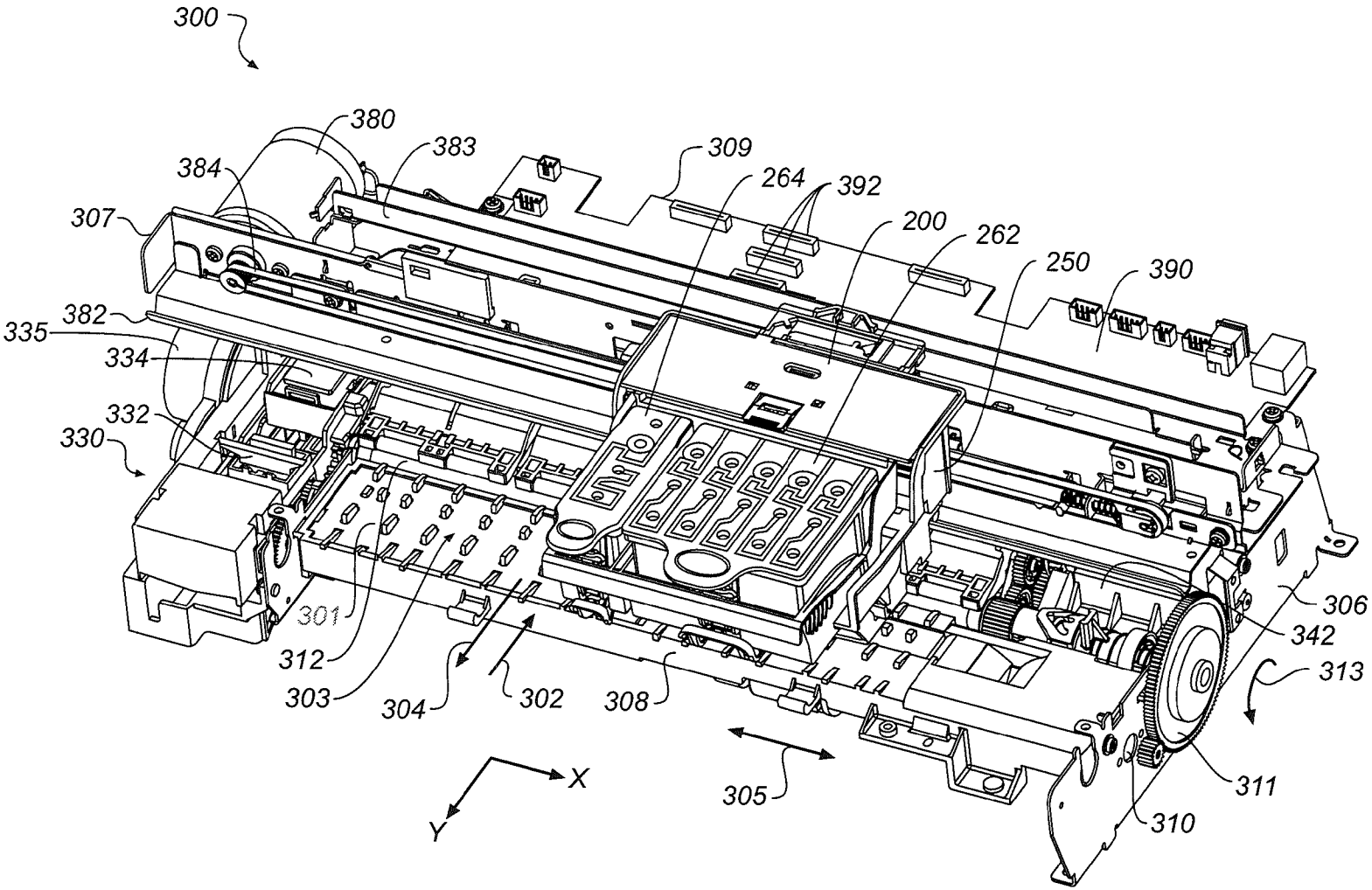
FIG. 3 is a perspective of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are mounted in the printhead 250. The mounting orientation of printhead 250 is rotated relative to the view in FIG. 2, so that the printhead die 251 are located at the bottom side of printhead 250, the droplets of ink ejected downward onto the recording medium 20 in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. Paper or other recording medium 20 (sometimes generically referred to as paper or media herein) is loaded along paper load entry direction 302 toward the front of printer chassis 308.

Figure 4:
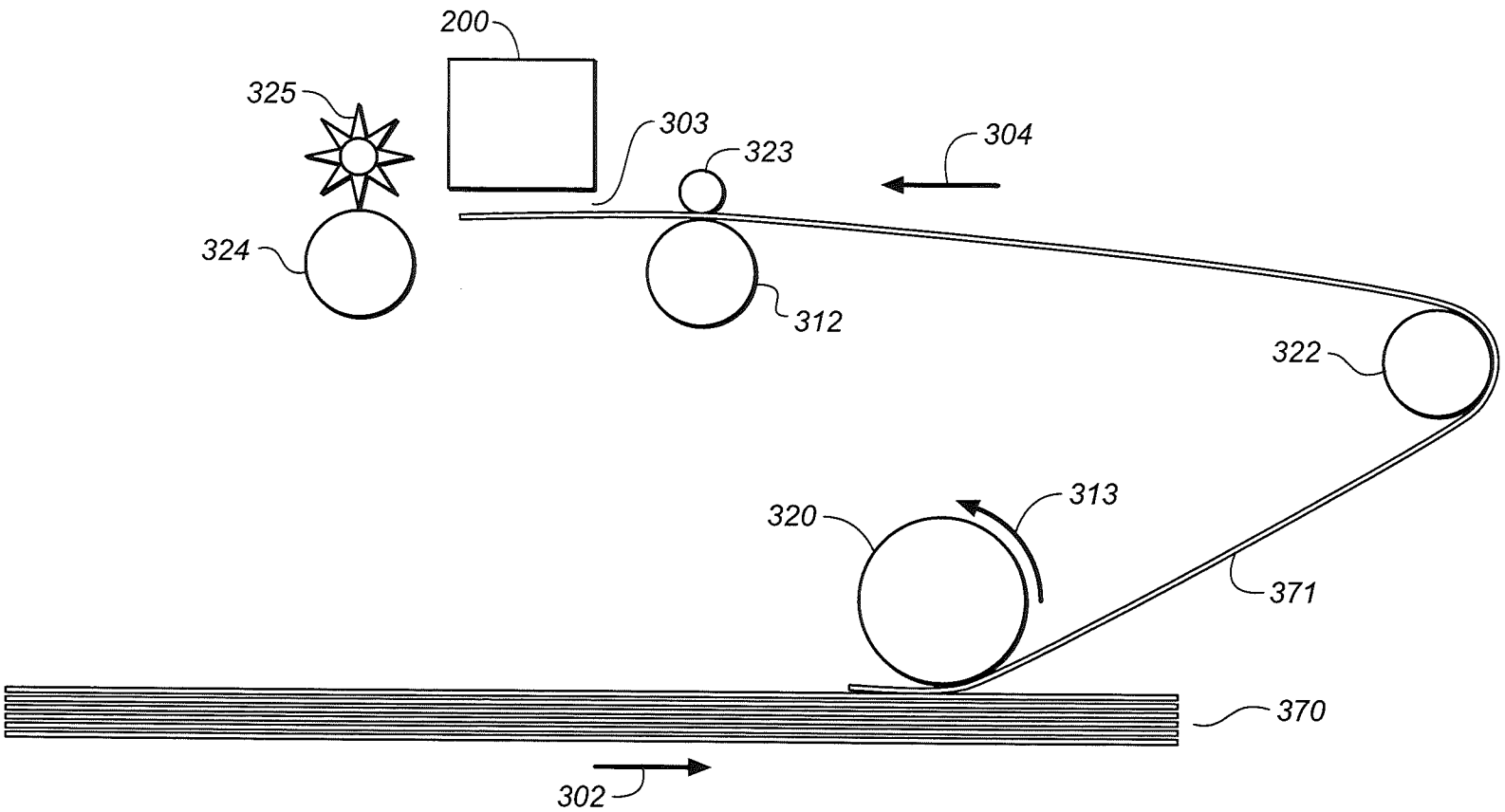
FIG. 4 is a schematic side view of an exemplary paper path in a carriage printer.

A variety of rollers are used to advance the recording medium 20 through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311(FIG. 3) is mounted on the feed roller shaft. Feed roller 312 can include a separate roller mounted on the feed roller shaft, or can include a thin high friction coating on the feed roller shaft. A rotary encoder (not shown) is coaxially mounted on the feed roller shaft in order to monitor the angular rotation of the feed roller 312 The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313.

Toward the rear of the printer chassis 309, in this example, is located an electronics board 390, which includes cable connectors 392 for communicating via cables (not shown) to the printhead carriage 200 and from there to the printhead 250. Also included on the electronics board 390 are typically motor controllers for the carriage motor 380 and for the paper advance motor, a processor and other control electronics (shown schematically as controller 14 and image processing unit 15 in FIG. 1) for controlling the printing process (including maintenance operations), a clock (not shown) and an optional connector for a cable to a host computer.

Toward the left side of the printer chassis 307, in the example of FIG. 3, is the maintenance station 330. Maintenance station 330 includes wiper 332, cap 334 and pump 335. In order to maintain the drop ejecting quality of the printhead 250 so that high quality images are produced even after periods where one or more nozzles has been inactive, a variety of maintenance actions have been developed and are well known in the art. These maintenance actions can include capping the printhead 250 to surround the nozzle face region with cap 334 during periods of nonprinting, wiping the nozzle face with wiper 332, periodically ejecting drops from the nozzles into cap 334 or other reservoir (such as spittoon 342) that is outside the printing region, and priming the printhead 250 by applying a suction pressure from pump 335 at the nozzle face when the printhead 250 is capped by cap 334. Priming is typically done to remove air from printhead 250. Priming also removes a significant amount of ink. A moderate level of priming can remove approximately 0.3 mL of ink, while a more extensive level of priming can remove approximately 0.6 mL of ink.

Figure 5:
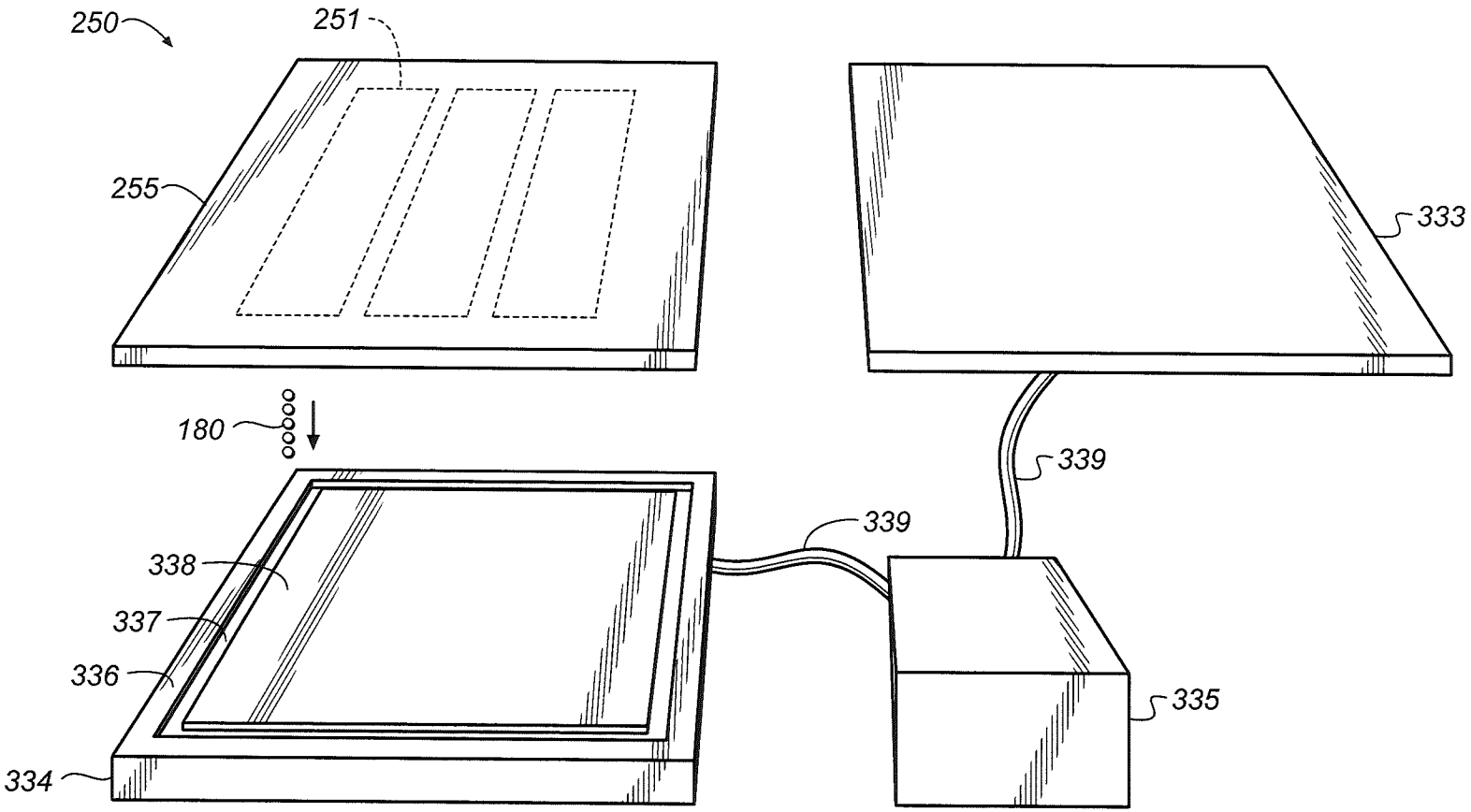
FIG. 5 is a schematic of a portion of a printhead with a maintenance station cap, a pump and a waste ink pad.

FIG. 5 (not to scale) schematically shows a portion of a printhead 250, a cap 334, a pump 335 and a waste ink pad 333. As in FIG. 2, three printhead die 251 are mounted on mounting substrate 255. The printhead die 251 are positioned over cap 334. In some maintenance operations such as priming, the cap 334 and its sealing surface 336 are brought into sealing contact with the face of the mounting substrate 255 surrounding the printhead die 251. In addition, during non-printing times the printhead is sealingly capped by cap 334 to protect the printhead die 251 and to inhibit evaporation from the nozzle arrays 253. For clarity in FIG. 5, the cap 334 and the mounting substrate 255 are shown as separated, so that the droplets 180 ejected from the leftmost printhead die 251 are visible. Within a recess 337 of cap 334 is a porous member 338 that can absorb and distribute a quantity of ink. Waste ink tubing 339 extends from cap 334 to a suction pump 335 in order to provide the suction pressure used during priming of the printhead 250 and to remove excess liquid from cap 334. Waste ink tubing 339 also extends from pump 335 to a waste ink pad 333 that can occupy significant space in the printer and is intended to accommodate the ink that is used in maintenance operations.

A particular event that typically triggers a suction priming maintenance operation is the changeover of an ink supply after an ink supply has been depleted. Embodiments of the present invention disclose a method of selecting a level of a maintenance operation. In particular, it has been found that the level of maintenance required after a changeover of ink supplies can be dependent upon the time interval between interrupting the ink supply connection to a printhead 250 and restoring ink supply connection to the printhead 250. There are a variety of ways that ink supplies can be connected to printheads. In some printers, the ink supply is stored in one or more ink tanks (e.g. 262 and 264) that are carried on carriage 200 as in FIG. 3. Connection of the ink tanks to the printhead 250 can be done via needle and septum, or by contact between a capillary medium at the outlet port of the ink tank and a filter-covered inlet port on the printhead for example. In other printers the ink is stored off-axis (not moved by the carriage) and ink is routed to the printhead 250 by flexible tubing. The details of implementation of the invention can vary according to requirements presented by different ink connection configurations. However, the method of controlling a maintenance operation according to embodiments of the invention generally includes: a) detecting that ink supply connection to a printhead has been interrupted; b) detecting that ink supply connection to the printhead has been restored; c) measuring a time interval between the interruption and the restoration of the ink supply connection to the printhead; and d) selecting a level of the maintenance operation, depending upon a length of the time interval.

Figure 6:
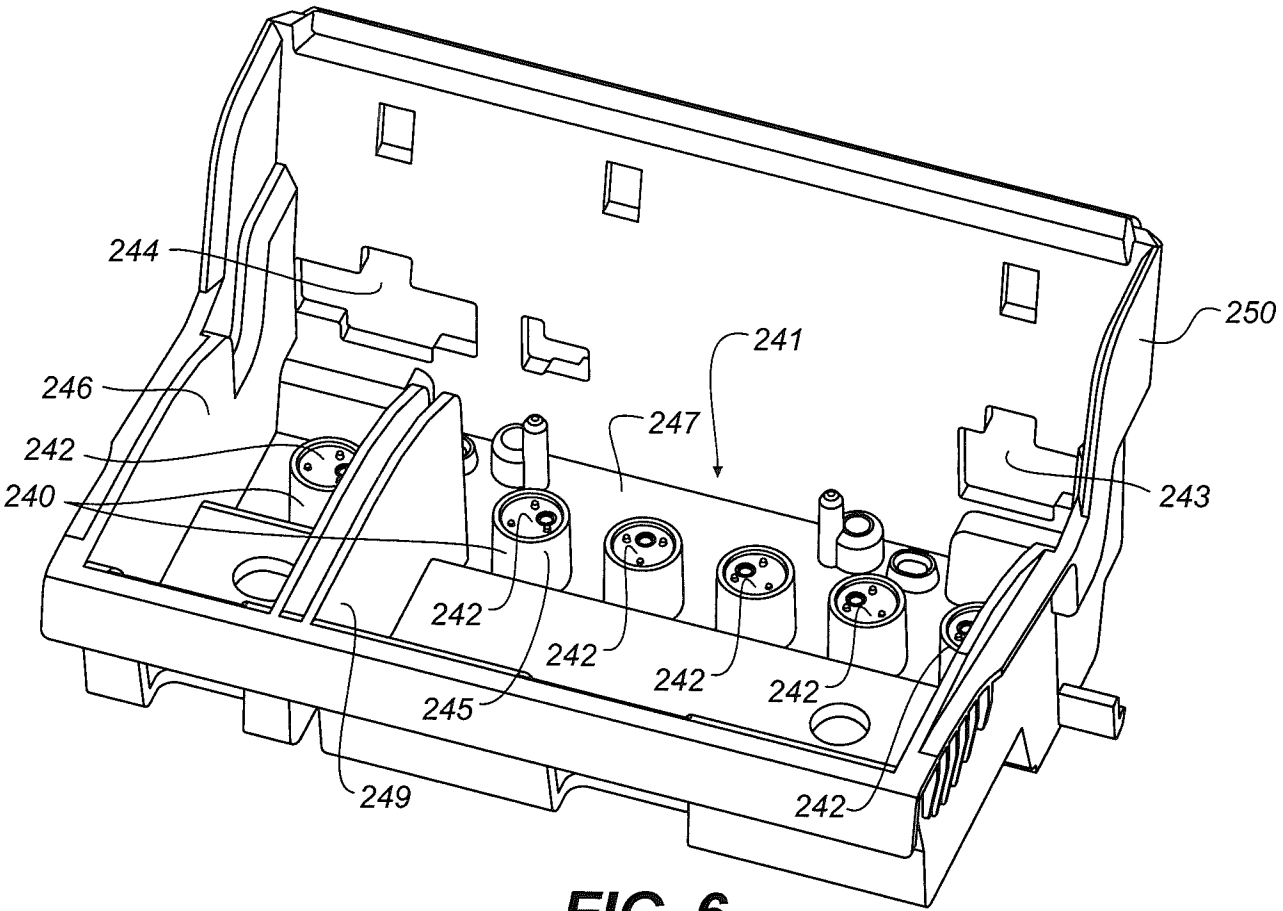
FIG. 6 is a perspective of a portion of a printhead.
Figure 7:
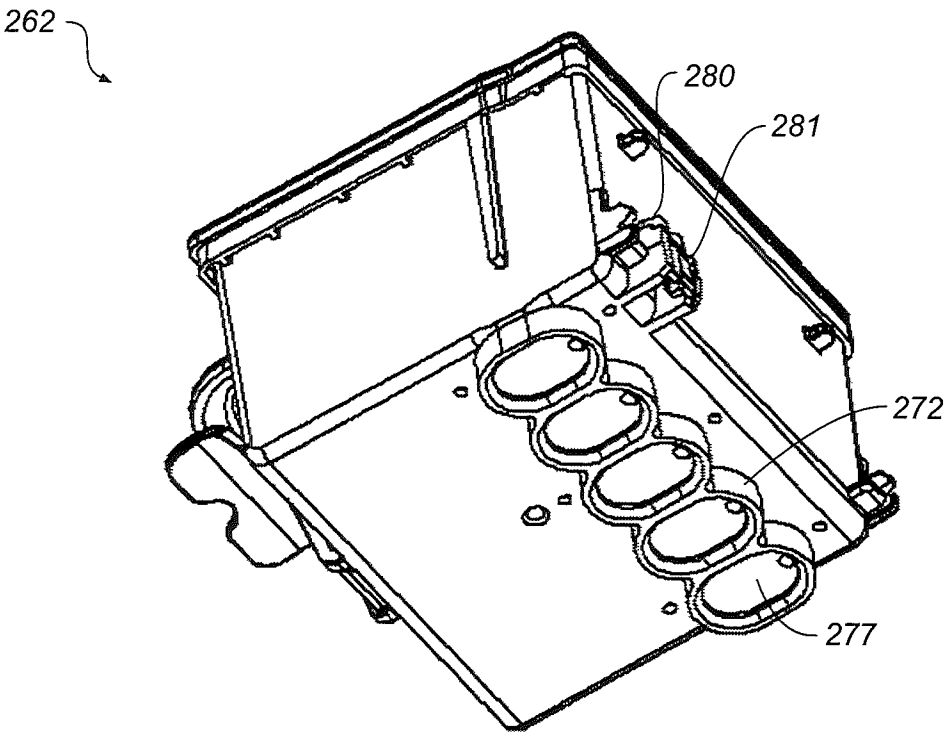
FIG. 7 is a perspective of a multi-chamber ink tank.

An example of the method will be described relative to an ink supply connection made by contact between a capillary medium at an outlet port of the ink tank and a filter-covered inlet port on the printhead 250. FIG. 6 shows a perspective of printhead 250 (rotated with respect to FIG. 2) without either replaceable ink tank 262 or 264 mounted onto it. Multi-chamber ink tank 262 (shown in FIG. 7) is detachably mountable in ink tank holding receptacle 241 and single chamber ink tank 264 is detachably mountable in ink tank holding receptacle 246 of printhead 250. Ink tank holding receptacle 241 is separated from ink tank holding receptacle 246 by a wall 249, which can also help guide the ink tanks during installation. In some embodiments, pedestal 280 (see FIG. 7) of multi-chamber ink tank 262 is inserted into hole 243 of printhead 250 during mounting of the multi-chamber ink tank 262. An electrical device 281 is provided on pedestal 280. A similar pedestal (not shown) and electrical device on single chamber ink tank 264 is inserted into hole 244 of printhead 250 during mounting of the single chamber ink tank 264. Five inlet ports 242 are shown in region 241 that connect with outlet ports 272 (FIG. 7) of multi-chamber ink tank 262 when it is installed onto printhead 250, and one inlet port 242 is shown in region 246 for the outlet port (not shown) on the single chamber ink tank 264. In the example of FIG. 6 each inlet port 242 has the form of a standpipe 240 that extends from the floor of printhead 250. Typically a filter (such as woven or mesh wire filter, not shown) covers the end 245 of the standpipe 240. The diameter of end 245 of standpipe 240 is smaller than that of the opening of outlet port 272 (see FIG. 7) of ink tank 262 or 264, so that the end 245 of each standpipe 240 is pressed into contact with a corresponding wick 277 made of a capillary medium at the opening of outlet port 272. In other words, wick 277 serves as a printhead interface member for the ink tank. On the floor of printhead 250 surrounding standpipes 240 of inlet ports 242 is an elastomeric gasket 247 (needs to be added to figure). When an ink tank is installed into the corresponding ink tank holding receptacle 241 or 246 of printhead 250, it is in fluid communication with the printhead 250 because of the connection of the wicks 277 at outlet ports 272 with the ends 245 of standpipes 240 of inlet ports 242.

It has been found for an ink supply connection as described above relative to FIGS. 6 and 7 that if excessive time elapses between removal of a detachable ink tank 262 and replacement of an ink tank 262, volatile components of the ink evaporate from the filter that covers the end 245 of standpipe 240 because the filter is no longer covered by a moist wick 277. When too much liquid is evaporated, a high negative pressure is generated in standpipe 240 below the filter. This negative pressure can grow to exceed the bubble point of the filter, resulting in air entering standpipe 240 through the filter pores. The level of suction priming that is needed is related to how much air gets into the printhead during ink tank removal and replacement. If a time interval between detecting removal of ink tank 262 from printhead 250 (thereby interrupting ink supply connection to printhead 250) and detecting replacement with the same ink tank 262 or with a new ink tank 262 (thereby restoring ink supply connection) is less than a first threshold value of 2 minutes, for example, no suction priming maintenance operation is required. If the time interval between removing an ink tank 262 and replacing an ink tank 262 is greater than or equal to the first threshold value and less than a second threshold value, for example 5 minutes, then a first level of suction priming is sufficient, such that the first level of suction priming removes approximately 0.1 mL to 0.2 mL of ink. If the time interval between removing an ink tank 262 and replacing an ink tank 262 is greater than or equal to the second threshold value, for example 5 minutes, then a second level of suction priming greater than the first level is needed, such that the second level of suction priming removes approximately 0.3 mL to 0.4 mL of ink. In this way the amount of ink that is depleted by suction priming is significantly lower over the life of the printer, thereby saving ink. In addition less waste ink is deposited into waste ink pad 333 (FIG. 5), so that a smaller waste ink pad 333 can be used in printers using the method disclosed herein. Second level of suction priming can be greater than first level of suction priming due to using a greater suction pressure for the second level, or using a duration of suction that is longer for the second level than for the first level.

Figure 8:
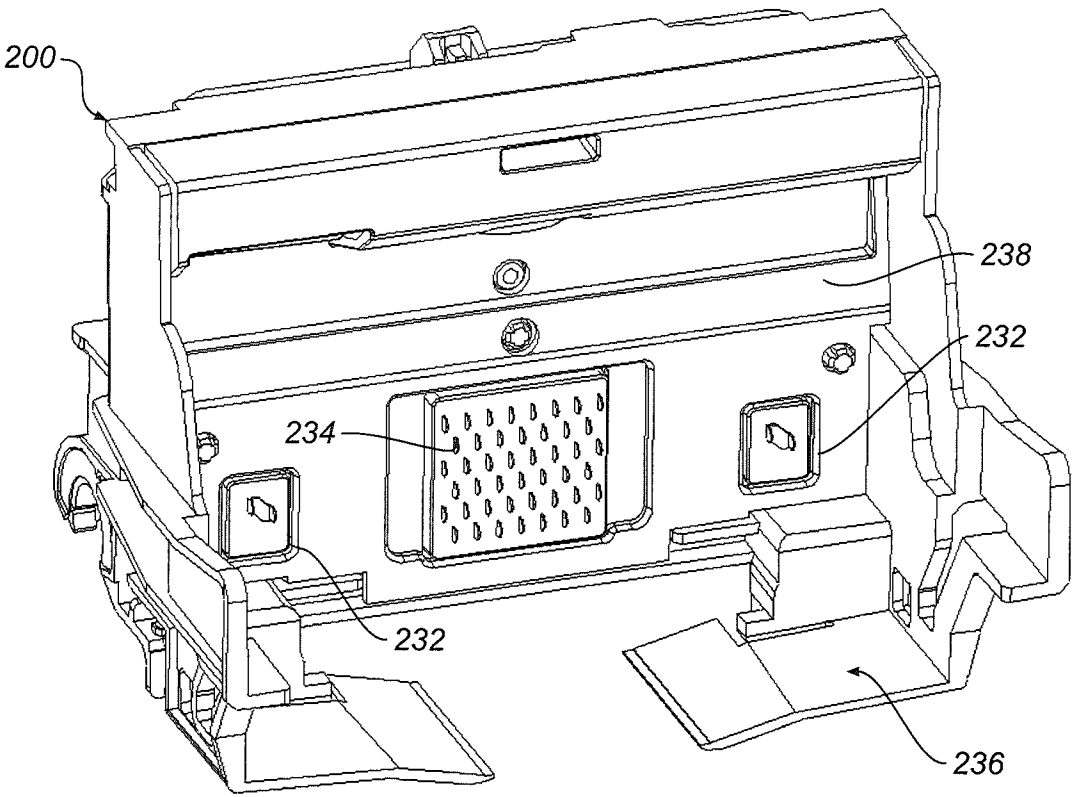
FIG. 8 is a perspective of a carriage.

FIG. 8 shows a perspective of carriage 200. With reference also to FIG. 2, holding receptacle 236 of carriage 200 receives a printhead 250. Printhead electrical connector 234 on rear wall 238 of carriage 200 mates with connector board 258(not shown) when the printhead is installed in the carriage. Electrical contacts of electrical device 281 on multi-chamber ink tank 262 (see FIG. 7) and single chamber ink tank 264 mate with electrical connectors 232 in carriage 200 when the printhead 250 and ink tanks 262 and 264 are properly installed. Detection of the removal of ink tank 262 or 264 is readily accomplished by detecting that electrical connection between electrical device 281 and electrical connector 232 has been broken. Similarly, detection of replacement of ink tank 262 or 264 is readily accomplished by detecting that electrical connection between electrical device 281 and electrical connector 232 has been established. Measurement of the time interval between detection of removal and replacement can be done using a clock included on printer electronics board 390 (FIG. 3), for example.

Electrical circuit 281 can be as simple as one or more electrical contacts that complete a circuit when they are in contact with electrical connector 232 and break a circuit when they are not in contact with electrical connector 232. Many ink tanks include an identification circuit that is used to track the amount of ink left in a particular ink tank. Such an identification circuit typically includes a unique identification code, as well as a description of manufacturing data such as an initial amount of ink, type of ink and the date of manufacture of the ink. In addition, the identification circuit typically includes memory for the printer electronics to store data relative to how much ink has been used from that ink tank by printing and by maintenance operations. For ink tanks including an identification circuit, the printer electronics typically reads the identification circuit in order to identify the particular ink tank and how much ink remains. In some events, the user can remove an ink tank and later replace the same ink tank in the printhead. In other events, the user can replace a depleted ink tank with a new ink tank having a different identity relative to the ink tank that was removed. In either case, the amount of maintenance (such as suction priming) is dependent upon how long the filter on standpipe 240 has been exposed to air, rather than being covered by moist wick 277.

Environmental factors such as temperature and humidity can affect the rate of evaporation of volatile ink components. In some embodiments, the method includes acquiring data corresponding to a temperature of an environment of the inkjet printer, and a level of maintenance is selected depending upon both the temperature and the time interval that elapsed between removal of an ink tank and replacing an ink tank. Many inkjet printers include a temperature sensor, for example on the printhead, so the data can be acquired by reading the temperature sensor provided in the printer. In some embodiments, the method includes acquiring data corresponding to a humidity of an environment of the inkjet printer, and a level of maintenance is selected depending upon both the humidity and the time interval that elapsed between removal of an ink tank and replacing an ink tank. Some inkjet printers include a humidity sensor, so the data can be acquired by reading the humidity sensor provided in the printer.

The printer chassis 300 shown in FIG. 3 does not have its housing and access cover attached. The access cover (not shown) is typically hinged in order to permit the user access to the carriage in order to remove and replace ink tanks. In some embodiments, a sensor can be used to indicate to the printer that the access cover has been opened. When the access cover has been opened, a frequent monitoring of the electrical circuit 281 can be initiated (for example once per second) in order to obtain an accurate indication of when electrical contact is broken and established.

In some events, two or more ink tanks will be replaced by the user in the same timeframe. For example, an ink monitoring feature of the printer can have notified the user that two different ink tanks are about empty. Rather than waiting for both ink tanks to become completely depleted, a user can wait until he is notified that one of the ink tanks should be replaced immediately. For his convenience, the user can decide to replace the nearly depleted ink tank as well. The method of controlling maintenance disclosed herein further contemplates detecting that a second ink tank has been removed from the printhead 250, detecting that the second ink tank has been replaced, and measuring a time interval between removal and replacement of the second ink tank. For printers having a single cap 334 covering all nozzle arrays 253 (as in the example of FIG. 5), the level of maintenance is selected according to the time interval of ink supply interruption that is longer, whether for the first ink tank or the second ink tank. For printers having independent caps and independent suction priming capability for different nozzle arrays 253, the level of maintenance is selected independently for the two different ink tanks according to the measured time intervals of respective ink supply interruption.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
180 Droplets
181 Droplet(s) (ejected from first nozzle array)
182 Droplet(s) (ejected from second nozzle array)
200 Carriage
232 Electrical connector
234 Printhead electrical connector
236 Holding receptacle (for printhead)
238 Rear wall
240 Standpipe
241 Region (for mounting multi-chamber ink tank)
242 Inlet port
243 Hole
244 Hole
245 End
246 Region (for mounting single chamber ink tank)
247 Gasket
249 Wall
250 Printhead
251 Printhead die
253 Nozzle array
254 Nozzle array direction
255 Mounting substrate
256 Encapsulant
257 Flex circuit
258 Connector board
262 Ink tank (multi-chamber)
264 Ink tank (single-chamber)
272 Outlet port
277 Wick
280 Pedestal
281 Electrical device
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
332 Wiper
333 Waste ink pad
334 Cap
335 Pump
336 Sealing surface
337 Recess
338 Porous medium
339 Waste ink tubing
342 Spittoon
370 Stack of media
371 Top piece of medium
380 Carriage motor
382 Carriage guide rail
383 Encoder fence
384 Belt
390 Printer electronics board
392 Cable connectors

The invention claimed is:

1. A method of controlling a maintenance operation in an inkjet printer comprising:

detecting that ink supply connection to a printhead has been interrupted;

detecting that ink supply connection to the printhead has been restored;

measuring a time interval between the interruption and the restoration of the ink supply connection to the printhead; and selecting a level of the maintenance operation, depending upon a length of the time interval; wherein if the time interval is greater than or equal to a first threshold value and less than a second threshold value, a first level of the maintenance operation is performed.

2. The method according to claim 1, wherein detecting that ink supply connection to the printhead has been interrupted includes detecting that an ink tank has been removed from the printhead.

3. The method according to claim 2, wherein detecting that the ink tank has been removed from the printhead further includes detecting that an electrical connection to the ink tank has been broken.

4. The method according to claim 2, wherein detecting that ink supply connection to the printhead has been restored includes detecting that an ink tank has been replaced in the printhead.

5. The method according to claim 4, wherein detecting that the ink tank has been replaced in the printhead further includes detecting that an electrical connection to the ink tank has been established.

6. The method according to claim 4, further including reading an identification circuit on the ink tank that was removed and on the ink tank that was replaced in the printhead.

7. The method according to claim 6, wherein the ink tank that was replaced has a different identity relative to the ink tank that was removed from the printhead.

8. The method according to claim 4, wherein the ink tank that was removed from the printhead being a first ink tank that was removed, the method further including:

detecting that a second ink tank has been removed from the printhead;

detecting that the second ink tank has been replaced in the printhead; and measuring a time interval between removal and replacement of the second ink tank.

9. The method according to claim 1, wherein if the time interval is less than the first threshold value, the maintenance operation is not performed.

10. The method according to claim 1, wherein if the time interval is greater or equal to than the second threshold value, a second level of the maintenance operation is performed, wherein the second level is greater than the first level.

11. The method according to claim 10, wherein a difference between the first level and the second level is a duration of the maintenance operation.

12. The method according to claim 10, wherein a difference between the first level and the second level is that an amount of ink removed by the second level of the maintenance operation is greater than an amount of ink removed by the first level of the maintenance operation.

13. The method according to claim 1, wherein the maintenance operation includes applying suction to nozzles of the printhead.

14. The method according to claim 1, further including acquiring data corresponding to a temperature of an environment of the inkjet printer, wherein selecting the level of the maintenance operation further depends upon the temperature.

15. The method according to claim 14, wherein acquiring data corresponding to the temperature includes reading a temperature sensor provided in the inkjet printer.

16. The method according to claim 1, further including acquiring data corresponding to a humidity of an environment of the inkjet printer, wherein selecting the level of the maintenance operation further depends upon the humidity.

17. The method according to claim 16, wherein acquiring data corresponding to the humidity includes reading a humidity sensor provided in the inkjet printer.

18. The method according to claim 1, further including detecting that an access cover of the inkjet printer has been opened.

* * * * *